United States Patent [19]

Oeggerli

[11] Patent Number: 4,997,528

[45] Date of Patent: Mar. 5, 1991

[54] MOLD FOR, AND METHOD OF, FABRICATING A PERFORATED BODY AND PERFORATED BODY FOR USE AS A FRICTION SPINNING ELEMENT

[75] Inventor: Werner Oeggerli, Winterthur, Switzerland

[73] Assignee: Maschinenfabrik Rieter AG, Winterthur, Switzerland

[21] Appl. No.: 409,922

[22] Filed: Sep. 20, 1989

Related U.S. Application Data

[63] Continuation-in-part of Ser. No. 117,841, Nov. 9, 1987, Pat. No. 4,882,015.

[30] Foreign Application Priority Data

Nov. 13, 1986 [CH] Switzerland ..... 04,543/86

[51] Int. Cl.[5] ..... C25D 1/08

[52] U.S. Cl. ..... 204/11; 204/24; 204/281

[58] Field of Search ..... 204/11, 24, 281

[56] References Cited

U.S. PATENT DOCUMENTS

| | | | |
|---|---|---|---|
| 3,046,202 | 7/1962 | Horner | 204/11 |
| 3,167,489 | 1/1965 | Hadjian | 204/11 |
| 3,332,858 | 7/1967 | Bittinger | 204/11 |
| 3,616,278 | 10/1971 | Jansen | 204/11 |
| 4,281,507 | 8/1981 | Didek et al. | 57/401 |
| 4,315,398 | 2/1982 | Parker et al. | 57/401 |
| 4,372,109 | 2/1983 | Farnhill et al. | 57/401 |
| 4,704,860 | 11/1987 | Stahlecker | 57/401 |
| 4,882,015 | 11/1989 | Oeggerli | 204/11 |

FOREIGN PATENT DOCUMENTS

| | | |
|---|---|---|
| 2819339 | 11/1979 | Fed. Rep. of Germany . |
| 2074201 | 10/1981 | United Kingdom . |
| 2,449,583 | 6/1975 | West Germany . |
| 2,919,316 | 11/1979 | West Germany . |
| 3,114,093 | 1/1982 | West Germany . |
| 0,175,862 | 9/1988 | E.P.O. |

OTHER PUBLICATIONS

Article in Publication Entitled "Metalloberfläche", 19th Publication Year, vol. 12, Dec. 1965, pp. 369 to 372, Münich, West Germany.

Article of H. J. Heinrich Entitled "Galvanoplastische Siebherstellung"; ARticle in 20th Publication Year, vol. 8, Aug. 1966, pp. 333 to 336. J.

Article of H. J. Heinrich, Entitled "Verfahren zur Beeinflussung der Lochprofile bei der Galvanoplastischen Siebherstellung".

*Primary Examiner*—T. M. Tufariello

*Attorney, Agent, or Firm*—Sandler, Greenblum & Bernstein

[57] ABSTRACT

The mold for producing a perforated body to be used as a friction spinning element comprises a mold body provided with throughpass holes extending between the opposite mold body surfaces. Each of the throughpass holes is filled with a non-conducting material. Thus, there can be simultaneously formed by electroforming at the opposite mold body surfaces two perforated bodies which may be of the same or different thickness. By virtue of the simultaneous fabrication of the two perforated bodies the openings or perforations thereof are exactly in alignment or coincident and, if desired, these two perforated bodies can be secured to one another in superposed orientation to form a composite friction spinning element, such as a friction spinning plate or disc or an endless friction spinning belt or band.

25 Claims, 3 Drawing Sheets

Fig. 10
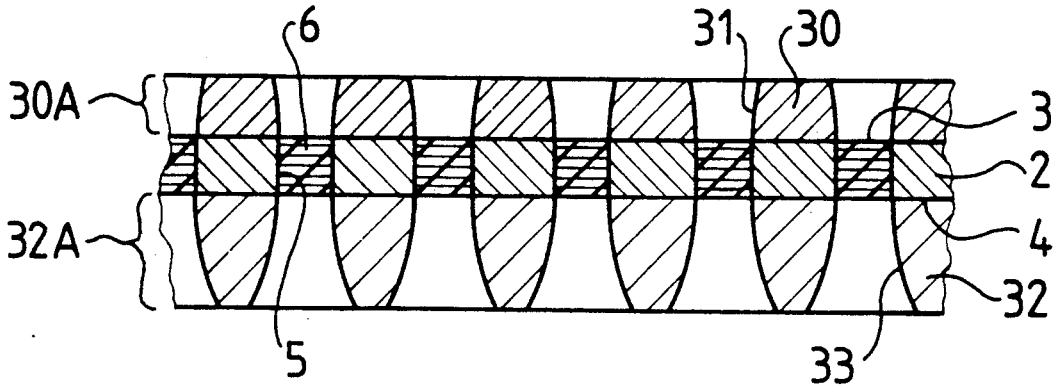
Fig. 11
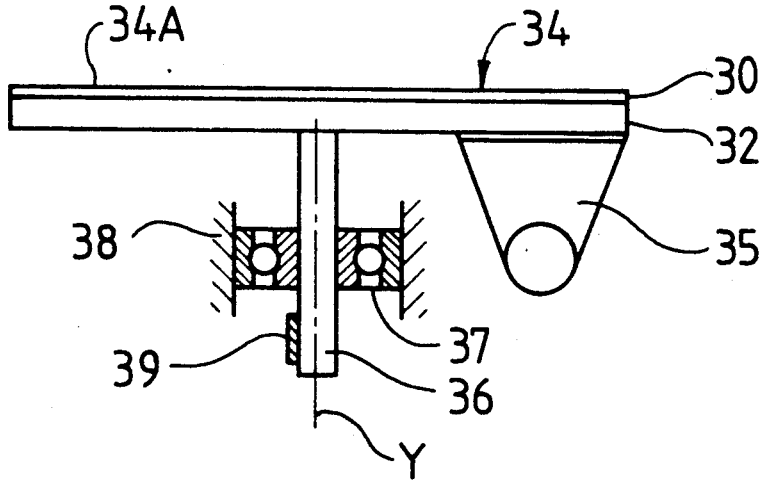
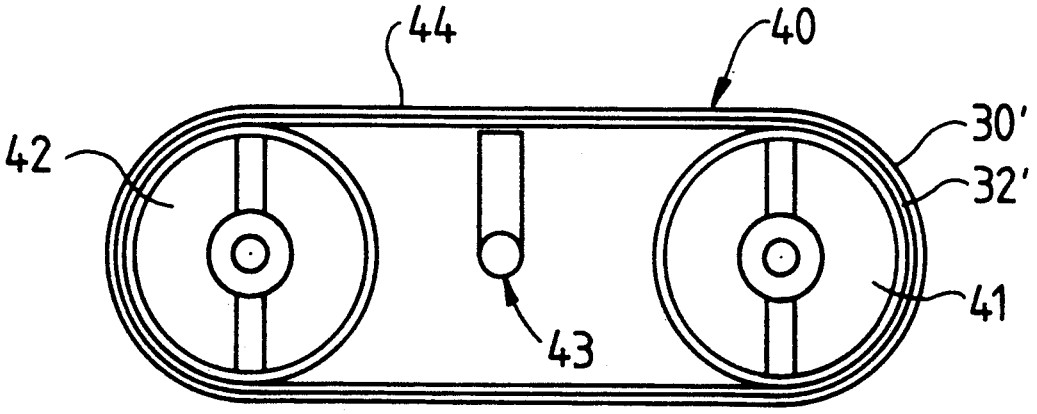
Fig. 12

MOLD FOR, AND METHOD OF, FABRICATING A PERFORATED BODY AND PERFORATED BODY FOR USE AS A FRICTION SPINNING ELEMENT

CROSS REFERENCE TO RELATED APPLICATIONS AND PATENTS

This application is a continuation-in-part of the commonly assigned, copending U.S. application Ser. No. 07/117,841, filed Nov. 9, 1987, and entitled "Method For Manufacturing A Perforated Body, Friction Spinning Means Using the Perforated Body And A Friction Spinning Device Using The Friction Spinning Means" now U.S. Pat. No. 4,882,015 granted Nov. 21, 1989. The present application is also related to the copending, commonly assigned divisional application Ser. No. 07/237,371, filed Aug. 29, 1988, and entitled "Friction Spinning Means Using A Perforated Body and A Friction Spinning Device Using The Friction Spinning Means", and also to the commonly assigned, copending U.S. application Ser. No. 07/119,497, filed Nov. 12, 1987, and entitled "Open End Friction Spinning Device For Production Of A Yarn Or The Like And Method For Production Of Friction Spinning Means", now U.S. Pat. No. 4,901,518, granted Feb. 20, 1990, the disclosures of which are incorporated herein by reference. This application is also related to the commonly assigned U.S. Pat. No. 4,848,079, granted July 18, 1989, and entitled "Friction Spinning Drum".

BACKGROUND OF THE INVENTION

The present invention relates to a new and improved mold for, and method of, fabricating a perforated body for receiving textile fibers or fibrous material deposited on a fiber receiving surface of the perforated body by means of an airstream and for passage of the airstream through perforations of the perforated body. The perforated body is advantageously used as a friction spinning means or element which, in turn, is used in a friction spinning device.

The present invention also relates to a new and improved construction of a composite friction spinning element for use with a friction spinning device.

The purpose of the friction spinning device is to take up fibers fed to a fiber receiving surface of the friction spinning means which may assume the shape of, for example, a perforated drum or disc or belt, in known manner by means of an air stream and to twist the fibers into a yarn or the like in a yarn formation region of a convergent zone formed by, for example, two cooperating friction spinning drums or a friction spinning disc and its cooperating conical roller. The yarn is withdrawn in a direction extending substantially at right angles to the direction of rotation of the friction spinning drums.

An example of the previously mentioned friction spinning method or process and a spinning device in which a friction spinning drum is used, has been disclosed in the commonly assigned European Published Patent Application No. 175,862. From that published patent application it is also apparent that the friction spinning means or element does not have to be in the form of a perforated drum; it could also, for instance, comprise a perforated disc combined with a conical roller.

Two perforated drums, as disclosed in the German Patent No. 2,449,583, or one imperforate drum and one perforated drum, or an imperforate conical roller and a perforated disc, as disclosed in the aforementioned European Published Patent Application No. 175,862, can be used as friction spinning means or elements.

The airstream required for transporting the fibers is drawn by suction through the holes or perforations in the friction spinning drum, friction spinning disc or friction spinning belt by means of an appropriately located suction nozzle, for example, in the interior of the friction spinning drum or below the friction spinning disc. It is therefore clear that the holes or perforations of this friction spinning means or element must have a cross-section or cross-sectional area in the narrowest section or region of each of the holes or perforations which, on the one hand, is so small that it substantially prevents take-up of too many fibers by these holes or perforations during deposition on the fiber receiving surface of the friction spinning means; such fibers may be either sucked away and lost, or at least cut on an edge of the mouth of the suction nozzle and thereby shortened.

On the other hand, the energy consumption of equipment of this kind should be held as low as possible, the required quantity and flow rate of air making up a substantial part of the energy consumption. Furthermore, efforts should be made to oppose the tendency towards blockage of the holes or perforations. In friction spinning means of this kind, it is therefore desirable to select the hole or perforation section at the narrowest region or throat to be as large as possible from this viewpoint.

However, these requirements placed on the hole or perforation diameter stand in direct opposition to each other.

From practical operation and from patent publications, for example, German Published Patent Application No. 3,114,093, it is known that these holes or perforations, when formed with a circular cross-section or cross-sectional configuration, generally have a diameter between 0.5 and 0.8 mm.

However, the perforated drums must have inherent stiffness or rigidity so that no deformation arises in use. This calls for a minimum wall thickness of at least 1 mm when brass is used with, for example, a drum diameter of 50 mm.

It is, however, apparent that boring of such small holes or perforations, where the number of holes or perforations is in the region of several tens of thousands of holes or perforations per drum, in a material of 1.0 to 1.5 mm or greater thickness, cannot be carried out without problems and is therefore expensive.

If additional demands are placed upon the form or configuration of the holes or perforations, as in the case of German Published Patent No. 2,919,316, then the manufacturer of such perforated drums is faced with special problems.

In the art of manufacturing spinnerets, it is known, for example, from U.S. Pat. No. 3,167,489 to produce a perforated plate by electroforming or galvanic deposition on a support plate from which filaments are extended under tension. The filaments are removed after the electroforming process and thus define the holes or perforations in the galvanically deposited plate. In a further known process such as known from U.S. Pat. No. 3,332,858, there is formed a mold containing protrusions which correspond to the desired spinneret holes or perforations. After the electroforming operation or galvanic deposition and removal from the mold, the protuberances formed at the location of the mold protrusions, are machined away to produce the spinneret.

In the art of galvanoplastic sieve or grid manufacture, it is known to produce a sieve or grid containing widening holes or perforations by electroforming or galvanic deposition of the sieve or grid material on a metallic support plate containing a non-conductive sieve or grid image which is sunk into or placed upon the surface at which the sieve or grid is formed, see the publication by H. J. Heinrich, entitled "Galvanoplastic Sieve Manufacture" in the Journal "Metalloberfläche", Vol. 19, No. 12, pages 369 to 372, 1965.

SUMMARY OF THE INVENTION

It is a primary object of the present invention to provide a new and improved mold for, and method of, economically manufacturing a perforated body of the initially mentioned type and which are not afflicted with the aforementioned drawbacks and shortcomings of the prior art.

Another significant object of the present invention is to provide an improved method of simultaneously fabricating perforated bodies, for example, in the form of perforated discs or endless perforated bands or belts for use as a friction spinning means or element, wherein each such perforated body possesses adequate inherent stiffness or rigidity and can be manufactured such that, on the one hand, the hole section of a hole or perforation at a predetermined location or position thereof is small enough to prevent or at least minimize undesirable passage of fibers therethrough as far as possible, while, on the other hand, the hole or perforation has a form which counteracts blockage of the holes or perforations and presents only a modest amount of airflow resistance to the airstream.

Yet a further decisive object of the present invention is the provision of a new and improved construction of a friction spinning means or element for use in a friction spinning device and wherein two perforated bodies are simultaneously fabricated with exactly coincident perforations or openings and secured to each other to form a composite friction spinning element containing precisely aligned openings or perforations.

Now in order to implement these and still further objects of the present invention, which will become more readily apparent as the description proceeds, the mold of the present development for the production by electroforming of at least one but, if desired, the simultaneous production of two perforated bodies is manifested, among other things, by the features that, an electrically conductive mold body is provided with throughpass openings or open-ended holes extending between opposite sides or surfaces of the mold body. The throughpass openings or open-ended holes are arranged at locations corresponding to those of the perforations or holes in the perforated body to be fabricated. Each such throughpass opening or open-ended hole in the mold body contains an inset electrical insulator filling.

By virtue of the provision of the throughpass openings or open-ended holes extending between opposite sides or surfaces of the mold body and which are each filled with an inset electrical insulator or electrically non-conductive filling, there is provided a mold for an advantageous production, by means of an electroforming or galvanic deposition process, of friction spinning means of the type as described in the commonly assigned, initially cross-referenced parent application.

As alluded to above, the invention is not only concerned with the aforementioned aspects of the mold structure, but also relates to a novel method of fabricating at least one perforated body. Generally speaking, the inventive method is directed to fabricating at least one perforated body for receiving textile fibers deposited on a fiber receiving surface of the perforated body by means of an airstream and containing perforations through which the airstream is passed and which widen in a predetermined direction.

To achieve the aforementioned measures, the inventive method, in its more specific aspects, comprises the steps of:

providing a mold having two opposite sides for the formation of two respective perforated bodies and containing inset electrical insulator fillings in open-ended holes, which extend between the two opposite sides of the mold, at a predetermined number of locations corresponding to the locations of the perforations in the two perforated bodies to be fabricated;

substantially simultaneously electroforming on said two opposite sides of said mold, the respective perforated bodies containing perforations which widen in a predetermined direction; and separating the two perforated bodies from the opposite sides of the mold.

Additionally and quite importantly, there is thus beneficially afforded the possibility of simultaneously fabricating two perforated bodies which have exactly aligned or coincident perforations or holes. The mold may be operated during electroforming such that, for example, two separate galvanic currents flow through the opposite sides or surfaces of the mold body. There are thus simultaneously fabricated two perforated bodies which may even have mutually different thicknesses or wall thicknesses, but the perforations or holes of these perforated bodies are exactly aligned or coincident, in other words have the same spacing from one another. During such process, the perforated bodies are formed such that their respective fiber receiving surfaces are directed towards the mold and their respective perforations widen in the respective airflow directions.

The inventive mold may also be used in corresponding manner for the fabrication of composite perforated bodies in the form of a disc or an endless belt or band. Again, two substantially simultaneously produced perforated bodies, preferably then of different thickness and with exactly coincident perforations or holes, are interconnected by using a suitable conventional connection method such as welding to form a composite disc or endless belt or band structure which is used as a friction spinning element.

It is a further advantage of the inventive method that the holes or perforations of the perforated bodies do not have to be circular or possess a circular cross-sectional configuration, but can have any other form or configuration because the throughpass openings or open-ended holes which extend between the opposite sides or surfaces of the mold body, can be made not only by boring but can also be produced with the aid of a photochemical process or by etching.

As also alluded to above, the invention is furthermore concerned with a new and improved construction of a composite friction spinning element for use with a friction spinning device.

To achieve the aforementioned measures, the inventive composite friction spinning element, in its more specific aspects, comprises:

a fiber receiving surface located on one side of the composite friction spinning element for depositing thereat textile fibers;

the fiber receiving surface and the composite friction spinning element contain a predeterminate number of holes defining perforations of a predeterminate configuration in a predeterminate distribution across the fiber receiving surface for passage of an airstream carrying the textile fibers to the fiber receiving surface; and each one of the predeterminate number of holes initially narrowing and then widening in the direction of flow of the airstream.

As a result, there can be obtained a friction spinning means or element like, for example, a friction spinning disc or belt of a composite structure in which, for instance, a thinner upper perforated body is attached to a thicker lower perforated body. The upper perforated body therein only has a slight widening of the perforations or holes which, however, do not possess any sharp edges. The lower perforated body nonetheless possesses a sufficiently large widening of the perforations or holes thereof in order to be able to effectively prevent the snagging or catching of fibers therein.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 10 illustrates in a longitudinal sectional view a second exemplary embodiment of the inventive method for substantially simultaneously producing two perforated bodies of different thickness by electroforming using the mold shown in FIG. 1;

FIG. 11 shows a schematic, partially sectional view of a friction spinning device provided with the composite perforated friction spinning disc obtained by the inventive method illustrated in FIG. 10 and drawn to a smaller scale; and FIG. 12 shows a schematic, partially sectional view of a friction spinning device provided with the composite perforated friction spinning belt obtained by the inventive method illustrated in FIG. 10.

DETAILED DESCRIPTION OF THE PREFERRED EMBODIMENTS

Figure 1:
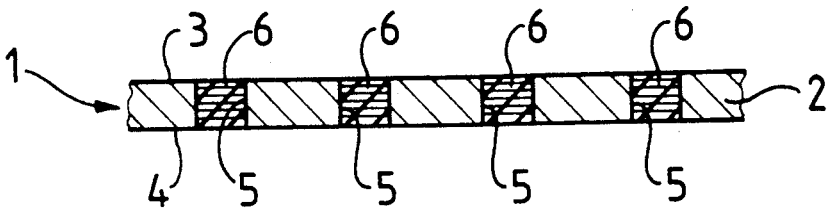
FIG. 1 shows a longitudinal section through part of an exemplary embodiment of the mold according to the present invention.

Describing now the drawings, it is to be understood that to simplify the showing thereof, only enough of the mold structure or equivalent device for forming the perforated body, the friction spinning means or elements, and the friction spinning devices, have been illustrated therein as are needed to enable one skilled in the art to readily understand the underlying principles and concepts of this invention. Turning now specifically to FIG. 1, there is shown therein by way of example and not limitation a section through a part of a mold or former 1 for production of a perforated body by a conventional galvanic or electroforming technique. Such perforated body is intended for receiving textile fibers deposited on a fiber receiving surface of the perforated body by means of an airstream and for passage of the airstream through the perforations of the perforated body.

The illustrated section through the part of the mold or former 1 as shown in FIG. 1, comprises a mold body 2 having two opposite sides or surfaces 3 and 4 and a predetermined number of open-ended holes which extend between the two opposite sides or surfaces 3 and 4 of the mold body 2. The predeterminate number of the open-ended holes 5 are arranged in a predeterminate distribution in correspondence with a predeterminate number and distribution of perforations in the perforated body to be electroformed by using the mold or former 1.

The open-ended holes 5 have a predetermined cross-sectional configuration such as, for example, a substantially circular cross-sectional configuration. Such open-ended holes 5 can be formed by known mechanical, photochemical and/or etching techniques.

Each one of the open-ended holes 5 contains or is filled by an inset electrical insulator filling 6. The mold body 2 constitutes an electrically conductive mold body.

Figure 2:
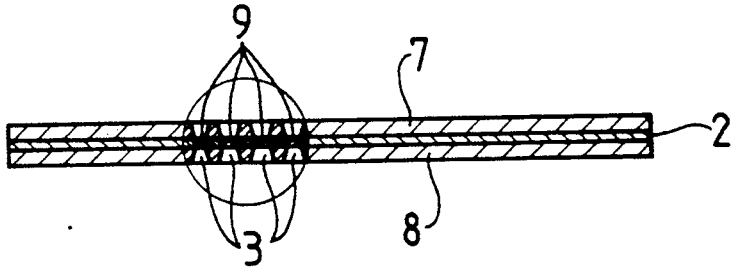
FIG. 2 illustrates in a longitudinal sectional view a first exemplary embodiment of the inventive method for substantially simultaneously producing two substantially identical perforated bodies by electroforming using the mold shown in FIG. 1.
Figure 3:
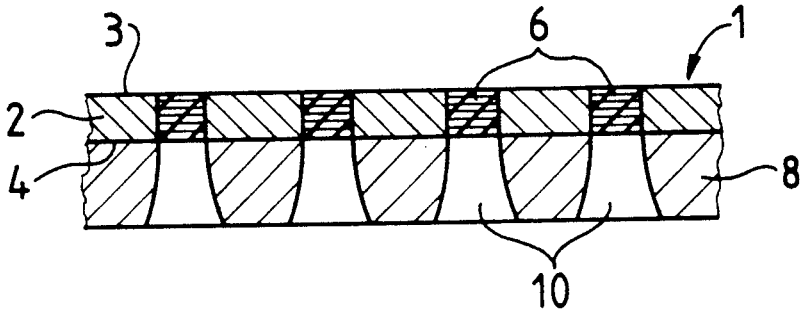
FIG. 3 shows part of the section of FIG. 2 at an enlarged scale.
Figure 4:
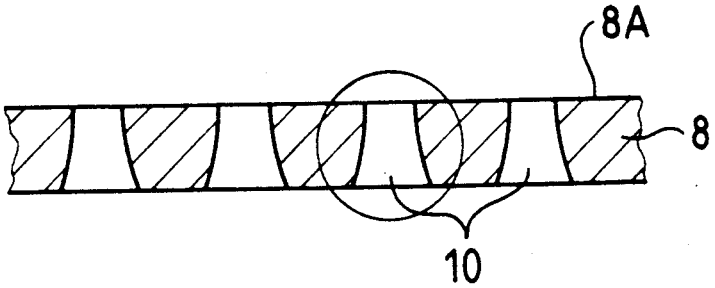
FIG. 4 depicts at an enlarged scale a longitudinal sectional view of part of one of the perforated bodies obtained as a result of carrying out the method as shown in FIG. 2.

A first exemplary embodiment of the inventive method for producing perforated bodies is illustrated in FIGS. 2 to 4 of the drawings. In order to carry out the inventive method which constitutes a galvanic or electroforming process, the electrically conductive mold or former 1 is connected to a current source in conventional manner such as to constitute the cathode at which the cations of at least one selected metal are deposited on the mold body 2 for building up the perforated body. The anode and the other components required for carrying out the galvanic or electroforming process are not shown because these components are not the subject of the invention and the structure of such components is well known in the galvanic or electroforming technology. Also, in the following, the manner of removing or stripping the perforated body which is formed at the mold body 2, is also not the subject of the invention, and therefore is not here further explained or described, particularly since conventional mold stripping techniques can be used.

As specifically illustrated in FIG. 2 of the drawings, the galvanic or electroforming process is carried out in a manner such that two perforated bodies 7 and 8 are substantially simultaneously formed at the two opposite sides or surfaces 3 and 4 of the mold body 2. Due to the presence of the inset electrical insulator fillings 6 in the open-ended holes 5 of the mold body 2, the perforated bodies 7 and 8 are formed with respective perforations 9 and 10 because the cations of the at least one selected metal forming the respective bodies are not deposited in the region of the inset electrical insulator fillings 6. The build-up of the perforated bodies 7 and 8 in the region of the inset electrical insulator fillings 6 is effected in a manner such that the perforations 9 and 10 which are respectively formed in the perforated bodies 7 and 8, assume a cross-sectional configuration corresponding to that of the open-ended holes 5 in the mold body 2 and a distribution which corresponds to the distribution of the open-ended holes 5. More specifically and as shown in FIG. 2 for part of the perforated bodies 7 and 8, the perforations 9 and 10 widen in a direction away from the mold body 2. The perforations 9 and 10 thus assume a diffusor-like configuration which is particularly advantageous for the intended use of the perforated bodies 7 and 8 as a friction spinning means or element in a friction spinning device to be described further hereinbelow.

FIG. 3 shows a section of the mold body 2 of the mold or former 1 after removal or stripping of the perforated body 7. Specifically, there is illustrated at an enlarged scale the manner in which the perforations 10 are formed in the perforated body 8 which has been deposited on the bottom side of the mold body 2. FIG. 4 shows the same section of the perforated body 8 after removal from the mold body 2. As already noted hereinbefore, the removal or stripping of the perforated bodies 7 and 8 from the mold body 2 is effected by conventional mold stripping techniques.

It should be noted that in the specifically illustrated example, the two perforated bodies 7 and 8 are electroformed with substantially equal thickness or wall thickness. Therefore, a section of the perforated body 7 when viewed in the manner of illustration in FIG. 4, would appear essentially identical to the section of the perforated body 8 as shown in FIG. 4. The electroforming conditions, however, can also be selected such that the perforated bodies 7 and 8 possess mutually different thicknesses or wall thicknesses. In any event, the holes or perforations 9 and 10 which are respectively formed in the perforated bodies 7 and 8, are present in the same number, configuration and distribution and in exact alignment to each other.

As illustrated in FIG. 4 the diffusor-shaped holes of perforations 10 are so arranged with respect to the mold body 2 that the narrowest section or region of each of the diffusor-shaped holes or perforations 10 opens onto or at a fiber receiving surface 8A of the perforated body 8. During use of the perforated body 8 in a friction spinning device, fibers are delivered in known manner by means of an airstream so as to be taken up by or deposited at such fiber receiving surface 8A. It is a distinct advantage of the here described galvanic or electroforming technique that two substantially identical or different perforated bodies 7 and 8 are produced substantially simultaneously and in a manner such that the fiber receiving surface of each one of the two perforated bodies 7 and 8 engages the mold body 2 during the galvanic or electroforming process.

As explained hereinbefore, the diffusor-shaped holes or perforations 9 and 10 are formed such as to exhibit continuous widening or enlargement in a direction away from the mold body 2, i.e. in a direction away from the fiber receiving surface as illustrated for the perforated body 8 and its fiber receiving surface 8A in FIG. 4 of the drawings. This constitutes a notable advantage from the point of view of airflow and of preventing blockage because the airstream enters the diffusor-shaped holes or perforations 9 or 10 at their narrowest sections or regions at the respective fiber receiving surfaces. There is thus obtained the beneficial result that the initially mentioned contradictory requirements made on the perforated bodies 7 and 8 are sufficiently satisfied, namely the requirement of substantially preventing take-up of too many fibers by the holes or perforations in the perforated body during deposition of fibers at the fiber receiving surface, as well as the requirement of holding low the energy consumption which is necessary for maintaining the desired airstream for transporting the fibers towards the fiber receiving surface.

FIG. 4 further demonstrates that a sharp, but burr-free edge is formed at the narrowest section or region of the diffusor-shaped holes or perforations 10 which open at this narrowest section or region onto the fiber receiving surface 8A.

Figure 5:
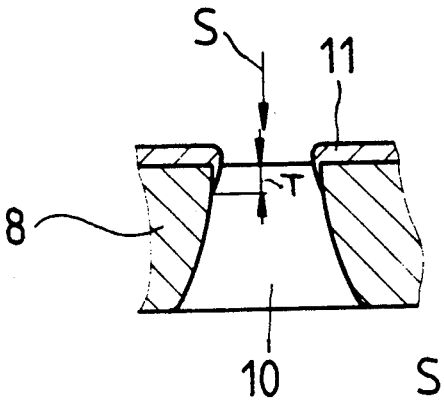
FIG. 5 shows a detail depicted on a larger scale and representing a hole or perforation in the one perforated body as shown in FIG. 4, and additionally illustrated to be provided with a coating or layer.
Figure 6:
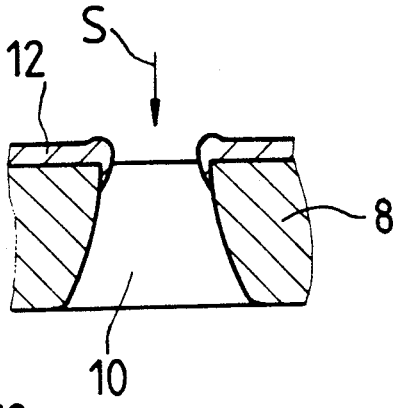
FIG. 6 shows the detail of FIG. 5 and a modification of the coating or layer.
Figure 7:
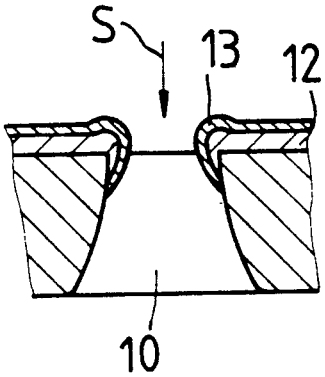
FIG. 7 shows the detail of FIG. 6 and an additional coating or layer.

FIGS. 5 to 7 illustrate further modifications of the inventive method which result in improvements in the function of the perforated body such as, for example, the perforated body 8 illustrated in FIG. 4. In FIGS. 5 to 7 there is illustrated for the reason of better clarity, only one of the perforations 10 which are present in the perforated body 8.

FIG. 5 shows, for example, a plasma coating or layer extending a certain distance T into the diffusor-shaped hole or perforation 10 as viewed in the direction of airflow S. In this way, the inherently sharp edge of the narrowest section or region of the diffusor-shaped hole or perforation 10 is somewhat rounded. The plasma coating or layer 11 serves to provide the fiber receiving surface 8A with a rough but wear resistant layer. The distance T is not essential in itself. However, the dimensions of the narrowest section or region of the diffusor-shaped holes or perforations 10 and the related dimensions of the open-ended holes 5 in the mold body 2 should be selected such that the constriction or narrowing caused by the plasma coating or layer 11 is taken into account.

FIG. 6 shows a galvanic coating or layer 12 on the fiber receiving surface 8A. For physical reasons, this galvanic coating 12 builds up a kind of ridge around the sharp edge of the narrowest section or region of the diffusor-shaped hole or perforation 10, thereby narrowing or constricting such narrowest section or region to a still greater extent than occurs with the plasma coating or layer 11 described hereinbefore with reference to FIG. 5. This galvanic coating or layer 12 can be applied either when the diffusor-shaped hole or perforation 10 should exhibit, after the narrowest section or region, a short but more sudden expansion or enlargement, as viewed in the direction of the airflow S, than is achieved by the initial electroforming method, the section or region then merging into the normal widening or enlargement of the initial galvanically formed or electroformed, diffusor-shaped hole or perforation 10, or when the initial galvanically formed or electroformed narrowest section or region is to be made still narrower.

FIG. 7 shows that an additional plasma layer or coating 13 can be deposited on the galvanic coating or layer 12 illustrated in FIG. 6 if a higher degree of roughness is required for the outermost layer or outer surface.

According to a further, not particularly illustrated modification of the inventive method, the fiber receiving surface 8A of the perforated body 8 may be subjected to a conventional roughening operation in order to produce a roughened fiber receiving surface. There is obtained the beneficial effect that there is greater friction between the fiber receiving surface and the fibers deposited thereupon so that the deposited fibers are less likely to slide or otherwise move along the fiber receiving surface during the time they are conveyed towards a yarn forming location.

Finally, it is mentioned that each diffusor-shaped hole or perforation 10 of the perforated body 8 has a surface or cross-sectional area of at least 0.07 $mm^2$ at the narrowest section or region thereof.

Figure 8:
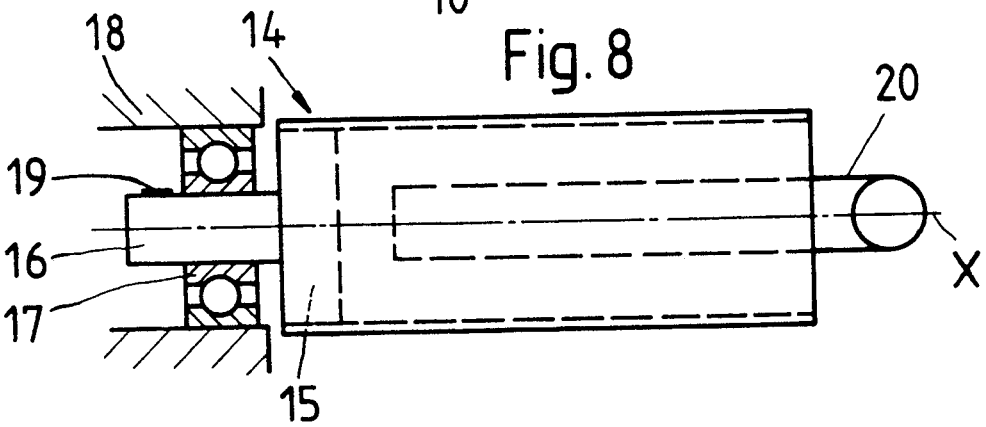
FIG. 8 shows a longitudinal view, partly in section and drawn to a smaller scale, of a friction spinning drum provided with the perforated body obtained by electroforming on the inventive mold illustrated in FIG. 1.

The mold body 2 or former 1 of which only a section has been illustrated in FIGS. 1 to 4, may have, for example, a substantially cylindrical configuration. As a result of such substantially cylindrical configuration, the perforated bodies 7 and 8 which are electroformed at the respective opposite sides 3 and 4 of the mold body 2, constitute perforated drums which differ in their diameters but may also differ in their mutual thicknesses or wall thicknesses whereas the number, configuration and distribution of their diffusor-shaped holes or perforations are essentially the same. Such perforated drums can be utilized as friction spinning drums in a correspondingly constructed friction spinning device, either as such or after modification of its fiber receiving surface according to any one of the methods illustrated in FIGS. 5 to 7. The principle of the construction of such friction spinning device is schematically illustrated in FIG. 8 which shows a friction spinning drum 14 as an example of a friction spinning means or element which is produced by the inventive electroforming process described hereinbefore with reference to FIG. 2. The friction spinning drum 14 is mounted on a support or support member 15 which, in turn, is appropriately supported for rotation about an axis X by means of a shaft 16 and a roller bearing 17 mounted thereon and carried in a bearing housing 18. The friction spinning drum 7 can be driven via the shaft 16 from, for instance, a drive belt 19.

The previously mentioned airstream or airflow is generated in known manner by a suction nozzle 20 or equivalent structure leading into a chamber of the perforated friction spinning drum 7.

Alternatively, the mold or former 1 and its mold body 2 may assume a planar or disc shape. As a result, the perforated bodies 7 and 8 which are substantially simultaneously electroformed on the respective opposite sides 3 and 4 of the mold body 2, constitute disc-shaped bodies provided with the predetermined number and distribution of respective diffusor-shaped holes or perforations 9 and 10. Such disc-shaped perforated bodies can also be used as friction spinning means or elements, either directly as such or after modification according to any one of the methods illustrated in FIGS. 5 to 7 in a correspondingly constructed friction spinning device.

Figure 9:
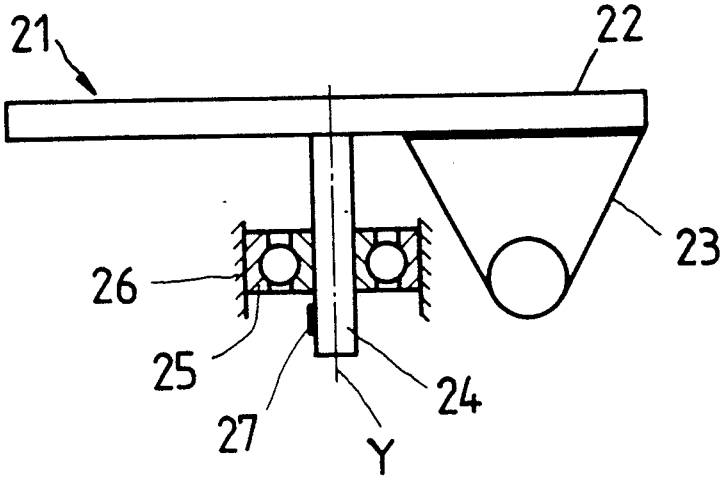
FIG. 9 shows a schematic partially sectional view at a smaller scale, of a friction spinning disc provided with the perforated body obtained by the inventive method as illustrated in FIG. 2.

The basic construction of such friction spinning device is schematically illustrated in FIG. 9 which shows a friction spinning disc 21 as a further example of a friction spinning means or element obtained as a result of the inventive electroforming process described hereinbefore with reference to FIG. 2. The upper surface of the friction spinning disc 21, as viewed in FIG. 9, constitutes a fiber receiving surface 22 onto which the diffusor-shaped holes or perforations open at their narrowest section or region. The airstream passing through the holes or perforations from the fiber receiving surface 22 is generated by a suction nozzle 23 provided on the underside of the friction spinning disc 21 as viewed in FIG. 9.

The friction spinning disc 21 is appropriately rotatably supported about a rotational axis Y by means of a shaft 24 secured thereto and received in a roller bearing 25. The roller bearing 25, in turn, is received in a bearing housing 26. The drive to the shaft 24 is transmitted, for instance, via a drive belt 27.

The hitherto described first exemplary embodiment of the inventive galvanic or electroforming process utilizes the mold body 2 in a manner such that there are obtained substantially identical perforated bodies 7 and 8 in the manner as illustrated in the sectional view of FIG. 2. As already explained hereinbefore, different perforated bodies 7 and 8 are obtained if the mold or former 1 or mold body 2 has the shape of a perforated drum.

However, the mold or former 1 or mold body 2, as also already explained hereinbefore, may assume a planar or disc shape. Also in such case, there can be deposited on the opposite sides or surfaces 3 and 4 of the mold body 2, different perforated bodies which differ, for example, by their thickness or wall thickness. In such case, as illustrated in FIG. 10 of the drawings, there is produced on the side or surface 3 of the mold body 2, a perforated body 30 having a predetermined thickness or wall thickness 30A and, on the opposite side 4 of the mold body 2, a perforated body 32 having a thickness or wall thickness 32A which is greater than the thickness or wall thickness 30A of the perforated body 30 formed on the side or surface 3 of the mold body 2.

Irrespective of the different thicknesses or wall thicknesses 30A and 32A, however, the two perforated bodies 30 and 32 are formed with respective diffusor-shaped holes or perforations 31 and 33 which widen in the aforedescribed manner in the direction away from the mold body 2. Due to the fact that the diffusor-shaped holes or perforations 31 and 33 are formed in the region of the inset electrical insulator fillings 6 which are placed into the open-ended holes 5 of the mold body 2, the diffusor-shaped holes or perforations 31 and 33 are produced in substantially equal numbers and in substantially equal distribution so as to be substantially aligned to each other.

According to the second exemplary embodiment of the inventive method described hereinbefore with reference to FIG. 10 of the drawings, the two different perforated bodies 30 and 32 containing the respective aligned diffusor-shaped holes or perforations 31 and 33, can be removed or stripped in conventional manner from the mold body 2 and joined to each other, either after or during the removal or stripping from the mold body 2. The joining operation can be carried out, for example, by joining marginal portions of the perforated bodies 30 and 32 by any suitable joining technique such as, for example, welding.

As a result of this joining operation, there is obtained a composite perforated body which can be used as a composite friction spinning means or element in any known friction spinning device of the type employing a substantially planar or disc-shaped friction spinning means or element. It is a particular feature of the thus obtained friction spinning means or element that the two perforated bodies 30 and 32 are joined in a back-to-back relationship and that the holes defining the perforations of the friction spinning means or element widen towards each one of the opposite sides thereof.

The composite friction spinning means or element is utilized in a manner such that the perforated body 30 having the smaller thickness or wall thickness 30A defines the fiber receiving surface. Due to the fact that in this perforated body 30 of the composite friction spinning means or element the diffusor-shaped holes or perforations 31 widen in a direction towards the fiber receiving surface, the edge formed at the location where the diffusor-shaped holes or perforations 31 open into the fiber receiving surface of the composite friction spinning means or element, is a less sharp or somewhat rounded edge which in any case does not require additional processing or treatment in order to prevent fibers from becoming stuck at the opening or entrance region of the diffusor-shaped holes or perforations 31.

However, if desired, the methods described hereinbefore with reference to FIGS. 5 to 7 can be utilized for modifying the entrance region of the diffusor-shaped holes or perforations 31.

The aforementioned composite friction spinning means or element composed of the joined perforated bodies 30 and 32 can be installed, for example, in a friction spinning device of the type as illustrated and described hereinbefore with reference to FIG. 9 and as now shown in FIG. 11. The friction spinning disc 34 contains a fiber receiving surface 34A at the upper perforated body 30 which is joined to the lower perforated body 32. The airstream passing through the diffusor-shaped holes or perforations 31 from the fiber receiving surface 34A is generated by a suction nozzle 35 arranged for cooperation with the perforated body 32 of the composite friction spinning disc 34. The composite friction spinning disc 34 is appropriately rotatably supported about a rotational axis Y by means of a shaft 36 secured thereto and received in a roller bearing 37 which, in turn, is received in a bearing housing 38. The drive to the shaft 36 is transmitted, for instance, by a drive belt 39.

The composite friction spinning means or element composed of the perforated bodies 30 and 32 can also assume the shape of a friction spinning band or belt 40 in a correspondingly constructed friction spinning device. The basic construction of such friction spinning device is schematically illustrated in FIG. 12 of the drawings. The two ends of the friction spinning band or belt 40 are joined to each other so that there is formed the continuous friction spinning band or belt 40 which is trained around two guide rolls 41 and 42 in conventional manner and cooperates in conventional manner with a suction device 43 located on a side opposite to the fiber receiving surface 44 of the composite friction spinning band or belt 40. As illustrated in FIG. 12, the composite friction spinning band or belt 40 is composed of two perforated bodies 30' and 32' which have essentially the same thickness or wall thickness. It should be understood, however, that the composite friction spinning band or belt 40 may also be composed of two perforated bodies 30 and 32 having different wall thicknesses as illustrated in FIG. 10 of the drawings.

While there are shown and described present preferred embodiments of the invention, it is to be distinctly understood that the invention is not limited thereto, but may be otherwise variously embodied and practiced within the scope of the following claims.

Accordingly, what is claimed is:

1. A mold for use in an electroforming process for fabricating a rigid perforated body for receiving textile fibers deposited on a fiber receiving surface of the perforated body by means of an airstream and for passage of the airstream through perforations of the perforated body, said mold comprising:

an electrically conductive mold body defining two opposite sides and respective surfaces on said two opposite sides;

said electrically conductive mold body containing a predetermined number of open-ended holes each extending between said two opposite sides and each having a predeterminate cross-sectional configuration of substantially constant diameter throughout its length between said two opposite sides;

said predetermined number of open-ended holes being arranged in said electrically conductive mold body in a predetermined distribution corresponding to a predetermined number and distribution of perforations in the rigid perforated body to be electroformed at the electrically conductive mold body;

each one of said predetermined number of holes being filled by an inset electrical insulator filling to the level of said respective surfaces on said two opposite sides of said electrically conductive mold body; and said respective surfaces on said two opposite sides of said electrically conductive mold body being free of electrical insulator material for simultaneously electroforming two of said rigid perforated bodies one on each of said two opposite sides of said electrically conductive mold body.

2. The mold as defined in claim 1, wherein:

each one of said predetermined number of open-ended holes in said electrically conductive mold body has a substantially circular cross-sectional configuration.

3. A method of fabricating at least one perforated body for receiving textile fibers deposited on a fiber receiving surface of the perforated body by means of an air stream and containing perforations through which the air stream is passed and which widen in a predetermined direction, comprising the steps of:

providing a mold having two opposite sides for the formation of two respective perforated bodies and containing electrical insulator fittings in open-ended holes, which extend between the two opposite sides of said mold, at a predetermined number of locations corresponding to the locations of the perforations in the two perforated bodies to be fabricated;

substantially simultaneously electroforming on said two opposite sides of said mold, the two respective perforated bodies containing perforations which widen in the predetermined direction; and separating said two perforated bodies from said two opposite sides of said mold.

4. The method as defined in claim 3, wherein:

said step of substantially simultaneously electroforming the two perforated bodies entails forming a fiber receiving surface on a predetermined surface of each one of the two perforated bodies and which predetermined surface is directed towards the mold; and during said step of substantially simultaneously electroforming said two perforated bodies containing perforations which widen in said predetermined direction, forming said two perforated bodies with perforations which widen in the direction of flow of the air stream through the perforations of the perforated body by means of continuous enlargement in a direction extending from said fiber receiving surface.

5. The method as defined in claim 4, further including the step of:

adhering at least one layer to the fiber receiving surface of each one of said two perforated bodies.

6. The method as defined in claim 5, wherein:

said step of adhering said at least one layer to the fiber receiving surface of each one of said two perforated bodies, entails providing the fiber receiving surface with a galvanic coating extending at least partially into the individual holes defining the perforations.

7. The method as defined in claim 6, further including the step of:

roughening said fiber receiving surface of each one of said two perforated bodies.

8. The method as defined in claim 7, further including the step of:

depositing a layer on said roughened fiber receiving surface.

9. The method as defined in claim 8, wherein:

said step of depositing said layer entails plasma coating said roughened fiber receiving surface.

10. The method as defined in claim 4, further including the step of:

roughening said fiber receiving surface of each one of said two perforated bodies.

11. The method as defined in claim 4, further including the steps of:

initially providing the fiber receiving surface of each one of said two perforated bodies with a galvanic coating extending at least partially into the individual holes defining the perforations; and depositing a plasma layer on said galvanic coating.

12. The method as defined in claim 3, wherein:

during said step of substantially simultaneously electroforming said two perforated bodies, forming two perforated bodies of different thickness and with substantially aligned perforations.

13. The method as defined in claim 3, wherein:

during said step of substantially simultaneously electroforming said two perforated bodies, electroforming two perforated bodies of different thickness and with substantially aligned perforations;

joining said two perforated bodies of different thickness in order to thereby produce a composite friction spinning element; and during said step of joining said two perforated bodies of different thickness, maintaining the perforations of said two perforated bodies in substantial alignment to each other.

14. The method as defined in claim 13, wherein:

during said step of separating said two perforated bodies from said two opposite sides of said mold, removing said mold from between said two perforated bodies prior to joining said two perforated bodies of different thickness in order to thereby produce the composite friction spinning element.

15. The method as defined in claim 13, wherein:

during said step of separating said two perforated bodies from said opposite sides of said mold, carrying out said step of joining said two perforated bodies of different thickness in order to thereby produce the composite friction spinning element.

16. The method as defined in claim 13, wherein:

said step of joining said two perforated bodies of different thickness entails joining said two perforated bodies of different thickness along marginal portions of said two perforated bodies of different thickness.

17. The method as defined in claim 16, wherein:

said step of joining said two perforated bodies of different thickness along their marginal portions entails welding to each other the marginal portions of said two perforated bodies of different thickness.

18. The method as defined in claim 13, wherein:

during said step of joining said two perforated bodies of different thickness, joining said perforated bodies in a back-to-back relationship at their sides facing said mold during said step of substantially simultaneously electroforming said two perforated bodies on said two opposite sides of said mold, such that a thinner one of the two perforated bodies of different thickness defines the fiber receiving surface of the composite friction spinning element.

19. The method as defined in claim 18, further including the step of:

adhering at least one layer to the fiber receiving surface of the composite friction spinning element.

20. The method as defined in claim 19, wherein:

said step of adhering said at least one layer to said fiber receiving surface entails providing the fiber receiving surface of said composite friction spinning element with a galvanic coating extending at least partially into the individual holes defining the perforations.

21. The method as defined in claim 20, further including the step of:

roughening said fiber receiving surface of said composite friction spinning element.

22. The method as defined in claim 21, further including the step of:

depositing a layer on said roughened fiber receiving surface of said composite friction spinning element.

23. The method as defined in claim 22, wherein:

said step of depositing said layer entails plasma coating said roughened galvanic coating on said fiber receiving surface of said composite friction spinning element.

24. The method as defined in claim 18, further including the step of:

roughening said fiber receiving surface of said composite friction spinning element.

25. The method as defined in claim 18, further including the steps of:

initially providing the fiber receiving surface of said composite friction spinning element with a galvanic coating extending at least partially into the individual holes defining the perforations; and depositing a plasma layer on said galvanic coating.

* * * * *